US010102989B2

(12) United States Patent
Hartmann et al.

(10) Patent No.: US 10,102,989 B2
(45) Date of Patent: Oct. 16, 2018

(54) ELECTRIC SWITCHING DEVICE FOR MEDIUM AND/OR HIGH-VOLTAGE USES

(71) Applicant: Siemens Aktiengesellschaft, Munich (DE)

(72) Inventors: Werner Hartmann, Weisendorf (DE); Steffen Lang, Hallerndorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/326,692

(22) PCT Filed: Jul. 2, 2015

(86) PCT No.: PCT/EP2015/065064
§ 371 (c)(1),
(2) Date: Jan. 17, 2017

(87) PCT Pub. No.: WO2016/008729
PCT Pub. Date: Jan. 21, 2016

(65) Prior Publication Data

US 2017/0213675 A1 Jul. 27, 2017

(30) Foreign Application Priority Data

Jul. 17, 2014 (DE) ..... 10 2014 213 944

(51) Int. Cl.
*H01H 33/662* (2006.01)

(52) U.S. Cl.
CPC ..... *H01H 33/66207* (2013.01)

(58) Field of Classification Search
CPC ..... H01H 33/662; H01H 33/66207; H01H 2033/6623; H01H 2209/034;
(Continued)

(56) References Cited

U.S. PATENT DOCUMENTS 3,590,184 A * 6/1971 Wachta ..... H01H 33/66261 218/136
4,002,867 A 1/1977 Cherry ..... 218/134
(Continued)

FOREIGN PATENT DOCUMENTS

DE 3840825 A1 6/1990 ..... H01H 33/664
DE 19839285 C1 4/2000 ..... H01B 3/00
(Continued)

OTHER PUBLICATIONS

German Office Action, Application No. 102014213944.9, 7 pages, dated May 13, 2015.
(Continued)

*Primary Examiner* — Renee Luebke
*Assistant Examiner* — William Bolton
(74) *Attorney, Agent, or Firm* — Slayden Grubert Beard PLLC

(57) ABSTRACT

An electric switching device may include at least two conductor elements that can be placed at a distance from one another and contacted with each other using a moving mechanism, and a housing that defines a circuit breaker chamber, wherein the housing is made of an insulator, and at least partly surrounds the conductor elements. At least one face of the housing may have a resistive coating made of a matrix material filled with a filler, wherein the coating has a sheet resistance between $10^8$ and $10^{12}$ ohm at the operating field strength, and is conductingly connected to the conductor elements.

15 Claims, 2 Drawing Sheets

(58) Field of Classification Search
CPC ..... H01H 2209/056; H01H 2209/078; H01H 33/24; H01B 3/004
USPC ..... 218/139, 136
See application file for complete search history.

(56) References Cited

U.S. PATENT DOCUMENTS

| | | | | |
|---|---|---|---|---|
| 5,808,258 | A * | 9/1998 | Luzzi | H01H 33/66207 218/136 |
| 6,130,394 | A * | 10/2000 | Hogl | H01H 33/66207 218/138 |
| 6,437,274 | B2 | 8/2002 | Claessens et al. | 218/3 |
| 6,645,886 | B1 | 11/2003 | Muhrer et al. | 442/139 |
| 6,891,122 | B2 * | 5/2005 | Renz | H01H 33/66261 218/136 |
| 2004/0040935 | A1 | 3/2004 | Heimbach et al. | 218/7 |
| 2004/0242034 | A1 * | 12/2004 | Rinehart | H01H 33/662 439/100 |
| 2005/0103514 | A1 | 5/2005 | Utsumi et al. | 174/350 |
| 2013/0244022 | A1 | 9/2013 | Rueger et al. | 428/324 |

FOREIGN PATENT DOCUMENTS

| | | | | |
|---|---|---|---|---|
| DE | 19958646 | A1 | 7/2001 | H01H 33/14 |
| DE | 102010052889 | A1 | 6/2012 | C09C 1/28 |
| FR | 2821479 | A1 | 8/2002 | H01B 3/00 |
| FR | 2971884 | A1 | 8/2012 | H01H 33/04 |
| JP | 2004265801 | A | 9/2004 | H01H 33/66 |
| WO | 2016/008729 | A1 | 1/2016 | H01H 33/662 |

OTHER PUBLICATIONS

International Search Report and Written Opinion, Application No. PCT/EP2015/065064, 26 pages, dated Sep. 29, 2015.

* cited by examiner

ELECTRIC SWITCHING DEVICE FOR MEDIUM AND/OR HIGH-VOLTAGE USES

CROSS-REFERENCE TO RELATED APPLICATIONS

This application is a U.S. National Stage application of International Application No. PCT/EP2015/065064 filed Jul. 2, 2015, which designates the United States of America, and claims priority to DE Application No. 10 2014 213 944.9 filed Jul. 17, 2014, the contents of which are hereby incorporated by reference in their entirety.

TECHNICAL FIELD

The invention relates to an electric switching device, in particular for medium- and/or high-voltage uses, comprising at least two conductor elements which can be placed at a distance from one another and contacted using a moving mechanism, and a housing which defines a switching chamber, is made of an insulator and at least partially surrounds the conductor elements.

BACKGROUND

For medium- and/or high-voltage uses, i.e. in general terms for voltages which are greater than 1 kV, the high voltages mean that switching devices of greater complexity are required which can withstand the electric fields which occur, are as resistant as possible to degradation effects and are also intended to avoid jump occurrences outside the actual switching chamber.

A classic example in this regard are vacuum circuit breakers (VCB) which are core components in energy transmission and distribution, in particular in switching systems thereof. They cover a large portion of the medium-voltage switching uses, i.e. switching uses within the range of 1 kV to 52 kV, for example, and also a relevant portion in low-voltage systems. The use thereof in high-voltage transmission systems, therefore, for example, for voltages of greater than 52 kV, is also increasing. While a VCB is closed for most of the time and consequently provides contact-making of the conductor elements, its primary task is the interruption of currents in alternating current systems under rated conditions, therefore in particular for switching on and switching off rated currents, or else preferably for interrupting currents under fault conditions, in particular in order to interrupt short circuits and to protect the systems. Other uses include the pure switching of load currents using contact-making conductor elements, which switching is generally used in low- and medium-voltage systems.

The vacuum interrupter (VI) is the core element of a VCB. A vacuum interrupter generally has a pair of contacts which are formed by corresponding conductor elements, of which at least one can be moved by means of a moving mechanism in order to be able to bring about the open and closed states of the switching device. One conductor element here is customarily moved axially with respect to the other fixed conductor element. The contacts can be manufactured on current-conducting bolts which are composed in particular of metal which provide both current conduction and heat conduction, and also the mechanical means for holding and/or moving the contacts.

A VI furthermore comprises a vacuum-tight housing and the moving mechanism mentioned and can also comprise a metal bellows which is connected on one side to the housing and on the other side to the moving conductor element, in particular the moving bolt. The housing is substantially formed by an insulating component, i.e. an insulator, for example a ceramic tube which is connected to the conductor elements by connecting elements, wherein, for example, use can be used of metal caps or the like which seal the insulating component in the axial direction in order to form the switching chamber. Within the switching chamber prevails a permanent high vacuum of less than $10^{-8}$ Pa which can be ensured, for example, for operating periods of at least 30 years by means of an appropriate configuration of the housing and of the caps. The vacuum is necessary in order to ensure the "make-brake operations" and to ensure the insulating properties of the switching device in the open state.

When the switching device is in an open state, firstly the rated voltage of the system has to be insulated, but, secondly also surge voltages of high amplitudes which may be triggered, for example, by a lightning strike on the system. If the switching device transfers from the closed into the open state, as consequently the contacts with the conductor elements are placed at a distance from one another, it is necessary to interrupt rated currents or short circuit currents which lead to the emergence of temporary voltage peaks via the VI that are significantly higher than the rated alternating voltages of the system.

High voltages in vacuum systems customarily produce free electrons due to field emission processes if the electric field strength is sufficiently high. The acceleration of the electrons in the high electric fields increases the kinetic energy of said electrons, for example up to energies which exceed some tens or even hundreds of KeVs. The interaction of said highly energetic electrons with the housing structures leads to the production of highly energetic X-ray radiation which can leave the vacuum interrupter. Whereas, under customary conditions, the fault current within the vacuum interrupter is minimal and does not produce any significant X-ray radiation portions, circumstances may arise, for example if temporary voltage peaks of high amplitude occur, in which the X-ray radiation which arises produces free electrons on and/or in the vicinity of the outer surface of the insulator. Said electrons can be accelerated by the electric fields on the insulator surface and in the vicinity thereof, interfere with the electric field distribution in sensitive regions and lead to a gap flashover, which leads to a fault in the operation of the vacuum interrupter.

Even in situations in which no detectable X-ray radiation exists, for example in low- and medium-voltage uses, the high electric fields in critical regions of the vacuum interrupter, for example at the connection of the insulator and of the metal caps by soldering (brazing), may lead to the emission of electrons, which leads to a significant amount of field emission. These electrons can also interfere locally with the electric field and lead to further strengthening of the field and/or to charge multiplication due to electron avalanches which, in turn, may result in the loss of the insulating strength and/or in the voltage resistance of the vacuum interrupter.

There are similar challenges on the inner surface of the vacuum interrupter, while an additional problem has to be solved. The interruption in the current (rated current and also short circuit current) causes parts of the contact material to evaporate and be distributed as hot metal vapor within the switching chamber. Said metal vapor can be deposited on the insulator surface and builds up a conductive metal layer over time. Said metal layer, even if it is only weakly conductive, can likewise interfere with the electric field outside and within the vacuum interrupter and can consequently cause a deterioration in the voltage resistance capability of the vacuum interrupter over time. Although it has been proposed in this context to provide, in the contact-making region of the conductor elements, a shielding element, which is likewise composed of metal, for catching free metal particles of the conductor elements, said shielding element, however, also influences the field distribution within the switching chamber, but also on the insulator.

For the reasons mentioned, the insulator, which is generally realized from ceramic, has to be capable of withstanding high voltages over its surface, even if X-ray radiation and free electrons are present or, in some cases, even if the insulator is soiled by dust particles which are accumulated electrostatically on the outer surface of the insulator. Since the insulator contributes significantly to the costs of a vacuum interrupter (or other switching devices) and also has a negative effect on the costs of other structural elements of the vacuum interrupter (or other switching devices), the insulator has to be optimized in respect of maximum dielectric strength for a minimal size.

This problem has been solved up to now in that the inner and the outer geometry of the vacuum interrupter has been selected in such a manner that the anticipated electric field strengths do not exceed empirically derived limits for a certain geometry of the vacuum interrupter. Since said limits cannot be precisely predicted, in particular for triple point regions and sharp metal edges, the design of vacuum interrupters depends not only on calculations regarding the electric field during the development process, but also requires a great deal of empirical optimization. This also refers to buildup of metal layers from the inner surfaces of the insulator, which layers, as already mentioned, are customarily intended to be avoided nowadays by using shielding structures (shielding elements) within the switching chamber. Nevertheless, the depositions of the metal vapor and the effect thereof on the dielectric strength of the vacuum interrupter cannot today be quantitatively predicted in a sufficiently precise manner.

Furthermore, it should be noted that the design processes mentioned all lead to a reduction in the insulating properties of the outer structure of the vacuum interrupter significantly under the dielectric strength of air or other gases which surround the vacuum interrupter, and therefore insulator sizes (length, diameter) which are not optimum in respect of costs and construction space are required. The addition of shielding elements with respect to the metal vapors leads to distortions of the electric fields, which occur during the operation, at the insulator, which may lead to strong fields at certain points and consequently to an overloading of the insulator caused by charges building up there. As has already been explained, other causes can also lead to such local high fields at the insulator of the housing of the vacuum interrupter, wherein the problems explained here also apply to other switching devices in addition to the vacuum interrupter, which is mentioned by way of example.

SUMMARY

One embodiment provides an electric switching device, comprising at least two conductor elements which can be placed at a distance from one another and contacted using a moving mechanism, and a housing which defines a switching chamber, is made of an insulator and at least partially surrounds the conductor elements, wherein at least one face of the housing has a resistive coating which is made of a matrix material filled with a filler, wherein the sheet resistance of the coating is between $10^8$ and $10^{12}$ ohm at operating field strength, and is conductively connected to the conductor elements.

In one embodiment, the non-linear exponent describing the upward gradient in the current/voltage characteristic of the coating is less than 6.

In one embodiment, the filler is or comprises tin oxide $SnO_2$ or silicon carbide SiC.

In one embodiment, the filler is or comprises tin oxide doped with antimony and/or silicon carbide doped with aluminum.

In one embodiment, the matrix material is selected from the group comprising elastomers, thermosetting plastics, thermoplastics and glass, and/or in that the filler concentration is 10 to 90% by weight, in particular 40-60% by weight.

In one embodiment, the coating has a thickness of 100 μm to 500 μm.

In one embodiment, the filler consists of particles of a grain size of 100 nm to 300 μm, in particular 1 μm to 50 μm.

In one embodiment, the particles are platelets made of a base material, in particular mica, which are coated with the resistance material defining the resistance properties, in particular tin oxide $SnO_2$ or silicon carbide SiC, preferably with a layer thickness within the range of 10 to 100 nm, and/or the particles are outwardly covered by an electrically conductive layer, in particular titanium oxide $TiO_2$.

In one embodiment, the sheet resistance is varied along the direction of extent of the conductor elements, in particular as a function of a change in the electric field along the direction of extent of the conductor elements under operating conditions.

In one embodiment, the variation of the sheet resistance along the direction of extent is achieved by varying the thickness of the coating and/or by using different fillers and/or by varying the concentration of the single filler.

In one embodiment, said switching device is embodied as a vacuum interrupter.

In one embodiment, in the contact-making region of the conductor elements, the vacuum interrupter has a shielding element which influences the electric field at the insulator, is arranged within the switching chamber and/or is held between two housing parts of the housing and is intended for catching free metal particles of the conductor elements.

BRIEF DESCRIPTION OF THE DRAWINGS

Example aspects and embodiments of the invention are described below with reference to the drawings, in which.

DETAILED DESCRIPTION

Figure 1:
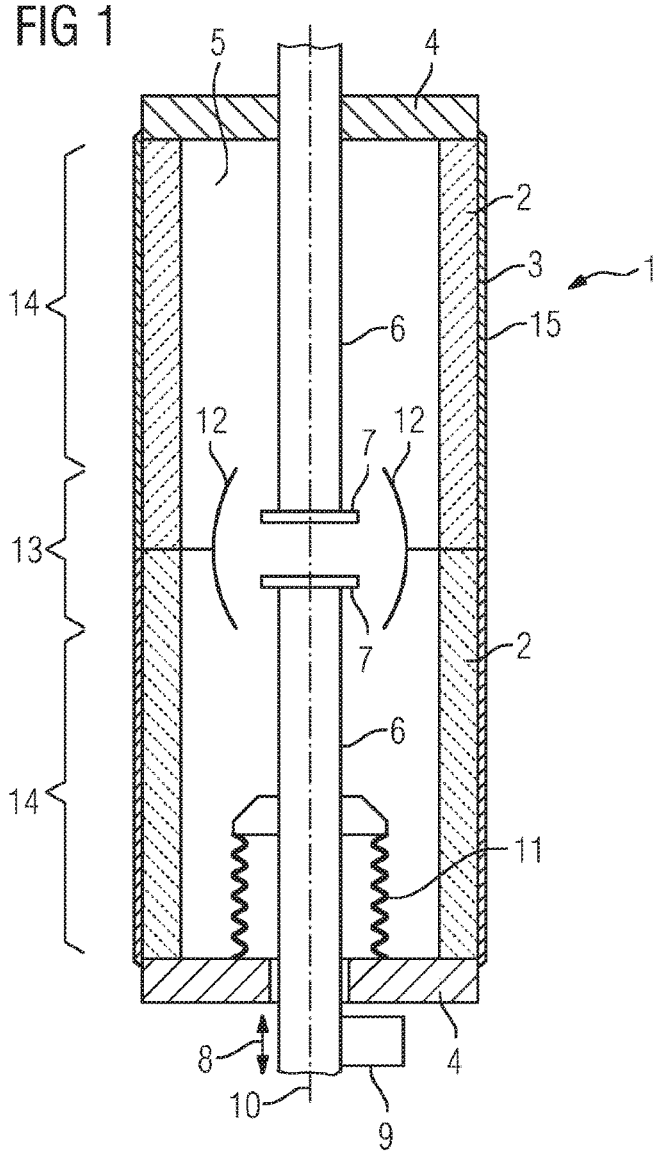
FIG. 1 shows a switching device according to the invention according to a first exemplary embodiment.

Embodiments of the invention provide a switching device with a housing surrounding an insulator, said switching device, despite being able to be realized in a simple manner, reducing distortions of the electric field in the region of the switching device due to surface charges.

In some embodiments, an electric switching has a housing in which at least one face of the housing, e.g., the outer face, has a resistive coating which is made of a matrix material filled with a filler, wherein the sheet resistance of the coating is between $10^8$ and $10^{12}$ Ω at operating field strength, and the coating is conductively connected to the conductor elements, in particular by conductive caps closing the housing on one side and holding the conductor elements.

The property spectrum of the coating is preferably also improved in that the non-linear exponent describing the upward gradient in the current/voltage characteristic of the coating is less than 6. The invention presented here is based on a special coating which is preferably applied to the outside of the insulator and can be applied before or during the production process of the housing, for example in the form of a glazing process of the housing composed of ceramic, or at the end of the production process by a dip treatment, spraying on or other suitable application processes such that a well defined coating is produced. The latter is preferably formed as homogeneously as possible, which means that as few inadvertent fluctuations of the sheet resistance along the housing as possible occur. Material combinations are already known, the properties of which can be adapted in such a manner that a certain sheet resistance of the coating is set. Since this may be implemented, for example, via the concentration of the filler, expedient refinements are conceivable in which the concentration of the filler is adapted in such a manner that a region is achieved in which the sheet resistance no longer significantly depends on the concentration of the filler, and therefore a coating is produced which is very easily reproducible. In order to set the desired sheet resistance, suitable measures can already be undertaken during the production since the sheet resistance can be reduced by a skillful choice of the grain size of the filler or of a conductive material, or of a conductive coating with particles of which the filler is composed, wherein the sheet resistance can also be increased via suitable doping.

A known example of a combination of materials which are suitable within the scope of such a coating is described by DE 198 39 285 C1. Although this involves a corona shielding strip, it has been demonstrated that the combination there of a base material and an inorganic filler which contains tin oxide is also suitable for producing a coating within the scope of the present invention in order to achieve the desired properties of the coating.

As has already been mentioned, variables influencing the resistance/the conductivity of the coating are, in addition to the thickness of the coating, the doping quantity, the concentration of the filler, the conductivity of the filler itself and the particle size of the filler. The coating is therefore fundamentally conductive as a whole, albeit at a high resistance, which leads, however, to a fault current being impressed in a targeted manner into the switching device in order to optimize the electric field distribution thereof under operating conditions. The conductive coating of the present invention leads to dispersal of surface charging which would otherwise accumulate on the insulator and would cause a distortion of the electric field. With a skillful choice of the properties, as already indicated, an extremely stable and reproducible, conductive layer which is resistant to corrosion and has a desired sheet resistance is produced.

The coating according to the invention therefore permits homogenization of the field distribution over the surface of the insulator. The coating is as substantially ohmic as possible here, which means it has the smallest possible dependency on the applied voltage (and therefore on the applied electric field). As has already been explained, it is particularly preferred if the non-linear exponent describing the upward gradient in the current/voltage characteristic of the coating is less than 6. This applies, for example, to the tin oxide, $SnO_2$, which has already been mentioned, but also to the silicon carbide, SiC, furthermore mentioned, and consequently also to the corresponding fillers. The non-linearity exponent mentioned, which is generally referred to as $\alpha$, is known in conjunction with voltage-dependent resistors (varistors). In the case of varistors, it is known from the voltage/current characteristic that the resistance decreases as the voltage increases, which is described by the non-linearity exponent $\alpha$, as emerges from the defining equation $$I=KU^{\alpha},$$

wherein I is the current, U is the voltage, K is a geometry-dependent constant and $\alpha$ is the non-linearity exponent.

Known combinations of coating materials use materials, the varistor properties of which are significantly more pronounced, for example fillers with zinc oxide, ZnO. This class of material has marked switching characteristics, i.e. shows a strong non-linear behavior above a certain threshold value of the electric field. Within the scope of the use of the present invention, this would lead to a drastic interference in the field distribution as soon as even only a portion of the coating exceeds said threshold value, which may already itself lead to a malfunction of the switching device. Even coatings which use graphite as part of the filler are rather unsuitable for the use described here since the disadvantage exists here that the resistance against corrosion, in particular the resistance against partial discharge erosion, is significantly poorer than in the materials described by the present invention; furthermore, the conductivity of such a coating would be significantly too high, and therefore the resistance heating occurring within the conductive coating would be too high.

In contrast to these examples, the soft characteristics of the material composition, according to the present invention, serve for a gradual reduction in the surface charges which would otherwise accumulate and/or would lead to electron avalanches close to the surface, and therefore, consequently, the coating according to the invention avoids a strong distortion of the electric field distribution. Electrons which become free due to X-ray radiation, charge accumulation or electron avalanches are therefore rapidly removed from the surface of the insulator, and therefore field distortions are substantially avoided. Consequently, the electric field strength on the surface of the switching device, consequently of the housing, is extremely homogeneous, thus resulting in turn in a reduction in the size, in particular in the length, and in other geometrical requirements imposed on the switching device. The switching device can be realized cost-effectively.

As has been explained, use is made here in a specific manner of material compositions which not only can be processed in a simple manner but also can be adjusted by simple modifications to certain desired sheet resistance values. It is preferred here, as already stated, if the filler is or comprises tin oxide $SnO_2$ or silicon carbide SiC. If the conductive properties of said substances are intended to be adapted by doping, a preferred refinement of the invention makes provision for the filler to be or to comprise tin oxide doped with antimony and/or silicon carbide doped with aluminum. For example, a doping of 0 to 15 mol % of antimony (Sb) in tin oxide ($SnO_2$) can be provided here.

It should also be noted at this juncture that these preferred combinations of material are suitable particularly for operating field strengths in the region of the insulator of 100 to 1200 V/mm.

The matrix material can be selected from the group comprising elastomers, thermosetting plastics, thermoplastics and glass. The various coating method for producing the coating can be selected accordingly. The matrix material can consequently be formed organically, for example as a polymer, or inorganically, for example as glass, in which the filler is introduced. It is expedient here if the filler concentration is 10 to 90% by weight, in particular 40 to 60% by weight. The preferred range of 40 to 60% by weight corresponds here to a volume portion of approximately 20 to 30% by vol. when tin oxide is used on mica platelets.

The thickness of the coating also has an influence here on the magnitude of the surface conductivity of the coating; in addition, thicker coatings in certain combinations of material tend to have more stable sheet resistance properties. Within the scope of the present invention, thicknesses of the coating of 100 μm to 500 μm have proven expedient.

The filler may comprise or consist of particles of a grain size of 100 nm to 300 μm, preferably 1 μm to 50 μm. If use is made of inorganic particles lying in the micrometer range, for example silicon carbide, a base material is not absolutely necessary, wherein, however, it may also be expedient, in particular if a filler comprising tin oxide $SnO_2$ is used, if the particles are platelets made of a base material, in particular mica, which are coated with the resistance material defining the resistance properties, in particular tin oxide $SnO_2$ or silicon carbide SiC, preferably with a layer thickness within the range of 10 to 100 nm. Consequently, use can be made of mica platelets which are covered with a layer of semi conductive material, in particular tin oxide. An alternative for the use of such platelets is quartz powder. In particular when the platelets are used, the aspect ratio also plays a role in the properties of the coating. For example, an aspect ratio of less than or equal to five for width to height can be set in platelets. If a filler with an emphasized aspect ratio is used, for example therefore platelets, it is in particular advantageously possible, as has already been explained at the beginning, to achieve a region in which the sheet resistance no longer significantly depends on the concentration of the filler, which increases the reproducibility of the coating.

A further possibility for adapting the sheet resistance, here specifically for increasing the conductivity, is a surface treatment of the particles, wherein it can be provided, for example, that the particles are outwardly covered by an electrically conductive layer, in particular titanium oxide $TiO_2$. Specifically in the case of smaller grain sizes and/or lower concentrations, a conductive coating of this type, preferably with titanium oxide, may be expedient in order to produce the desired conductive properties and therefore sheet resistances.

It is true that an extremely advantageous refinement has already been provided if an extremely homogeneous surface resistance is present over the surface of the insulator, consequently throughout the coating, which at any rate leads to sufficient removal of surface charges and to the homogenization of the electric field at the insulator. Nevertheless, situations are conceivable in which the use of background knowledge to locally vary the sheet resistance may lead to even better results, and therefore, for example in regions in which it is known that high fields occur in any case, for example because of other components of the switching device, a lower sheet resistance can be selected so that charges are distributed more rapidly than in regions of lower operating field strength. Since switching devices are generally configured symmetrically around the direction of extent of the conductor elements (and consequently also the direction of movement of the at least one movable conductor element), in a preferred refinement of the invention the sheet resistance is varied along the direction of extent of the conductor elements, in particular as a function of a change in the electric field along the direction of extent of the conductor elements under operating conditions. Such a variation in the resistance along the direction of extent can be achieved by varying the thickness of the coating and/or by using different fillers and/or by varying the concentration of a single filler, for which purpose suitable production techniques are already known in the prior art. A certain profile of the sheet resistance can thus be realized, for example, over the length of the switching device, whether by changing the thickness of the coating, by using different fillers having different conductivities, the respective concentration of which changes along the length of the switching device, or whether by varying the concentration of the single filler over the length of the switching device.

It is thus possible to undertake an adaption in respect of prior knowledge of the distribution of the electric field during operation of the switching device.

The switching device can be embodied in particular as a vacuum interrupter. If it is now furthermore provided that in the contact-making region of the conductor elements, the vacuum interrupter has a shielding element which influences the electric field at the insulator, is arranged within the switching chamber and/or is held between two housing parts of the housing and is intended for catching free metal particles of the conductor elements, the field distortion frequently also occurs by means of the shielding element (which may also be referred to as vapor shield), which field distortion can be significantly homogenized or compensated for by the use of the coating within the scope of the present invention, and the effects of said field distortion, for example charge accumulations, can be avoided. For example, in the case of such shielding elements, the operating field strength in the region of the shielding element itself, i.e. behind or next to the shielding element, may become weaker, whereas greater operating field strengths may occur over the length of extent of the shielding element adjoining the insulator. This knowledge can also be used in order, as has been just been explained, to vary the sheet resistance depending on location.

FIG. 1 shows a first exemplary embodiment of a switching device 1 according to the invention, here a vacuum interrupter, in the form of a schematic diagram. A housing 3 composed here of two tubular ceramic parts, i.e. insulators 2, is sealed by metal caps 4 and defines a switching chamber 5 into which two conductor elements 6, which are embodied, for example, as bolts and have contacts 7, are guided. The lower of the conductor elements 6 in FIG. 1 is designed to be movable in accordance with the arrow 8 and the indicated movement mechanism 9 and can be displaced in the direction of extent 10 of the conductor elements 6, which direction of extent also forms the axis of symmetry of the switching device 1, in order to bring the contacts 7 into contact or to place them at a distance from one another, wherein an open state of the switching device 1 is shown here. Owing to the mobility of the lower conductor element 6, the latter is coupled to the metal cap 4 via a metal bellows 11; the metal caps 4 are therefore conductively connected to the conductor elements 6 on both sides.

A vacuum, in the present case having a pressure of $<10^{-8}$ Pa, prevails within the switching chamber 5.

In order, for example when opening the switching device 1, not to allow metal vapors which arise to pass onto the inner surface of the insulator 2, here ceramic, a metal shielding element 12 (vapor shield) is provided here in the contact-making region in the switching chamber 5. However, said shielding element 12 also causes a distortion of the electric field, and therefore a smaller electric field would be present in a region 13 behind the shielding elements during operation than in the regions 14 where, for example, charges may accumulate and may therefore provide further field distortions which could place the operability of the switching device 1 into question. In order to counteract this, the outer face of the insulator 2 (and consequently of the housing 3 in the region of the insulator 2) is provided with a resistive coating 15 which covers the entire outer surface of the insulator and conductively contacts the caps 4 on both sides of the switching device 1, for example by means of a soldered connection or the like. Consequently, the resistive, but conductive coating results in a conductive connection between the conductor elements 6, and therefore, although a small fault current arises, the latter, because of the high resistance of the coating 15, in the present case in the region of $10^{10}$ Ω, is not substantial, but contributes to the field alignment and to transporting away its surface charges. Even fields which are too high are unproblematic for these properties since the non-linearity exponent describing the upward gradient in the current/voltage characteristic of the coating 15 is significantly lower than 6, in the present case within the range of 4 to 4.5. Flashovers are consequently avoided even in the case of transient voltage peaks.

The coating 15 is composed of a material composition which first of all comprises a base material, in the present case glass, in which a filler is provided. The filler is contained to up to 50% by weight. The filler is tin oxide, $SnO_2$, which is applied as resistance material to mica platelets which have an aspect ratio of width to height of less than 5 and sizes within the range of 1 to 50 μm. The thickness of the layer of the resistance material on the platelet is between 10 and 100 nm, wherein the entire thickness of the coating 15 is 250 μm here.

Exemplary embodiments are conceivable in which the resistance material is still doped, in the example described here by tin oxide ($SnO_2$) with antimony (Sb), wherein the doping can be realized here with 0 to 15 mol %. Another refinement makes provision for titanium oxide, $TiO_2$, to be additionally also applied to the platelet if the conductivity is intended to be increased.

Figure 2:
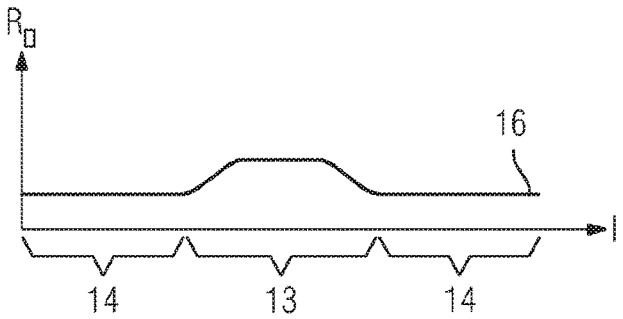
FIG. 2 shows a possible profile of the sheet resistance along the direction of extent of the conductor elements.

The sheet resistance can be homogeneous and therefore constant here over the entire coating 15. However, it is also conceivable to allow prior knowledge to have an effect in order to realize a variation in the sheet resistance depending on the position in the direction of extent 10, i.e. longitudinal direction of the switching device 1, and therefore, for example in the region 13 behind the shielding element 12, a higher sheet resistance can be present than in the regions 14. This is illustrated schematically in FIG. 2 which shows the sheet resistance $R_{??}$ to the position 1 in the direction of extent 10 and the regions 13 and 14. It is seen that the profile 16 of the sheet resistance shows an increase in the region 13.

This can be achieved by varying the thickness of the coating 15, by using two different fillers having differing conductivity and varying the concentrations thereof along the direction of extent 10, or else by using a single filler and varying the concentration thereof in the direction of extent 10.

Figure 3:
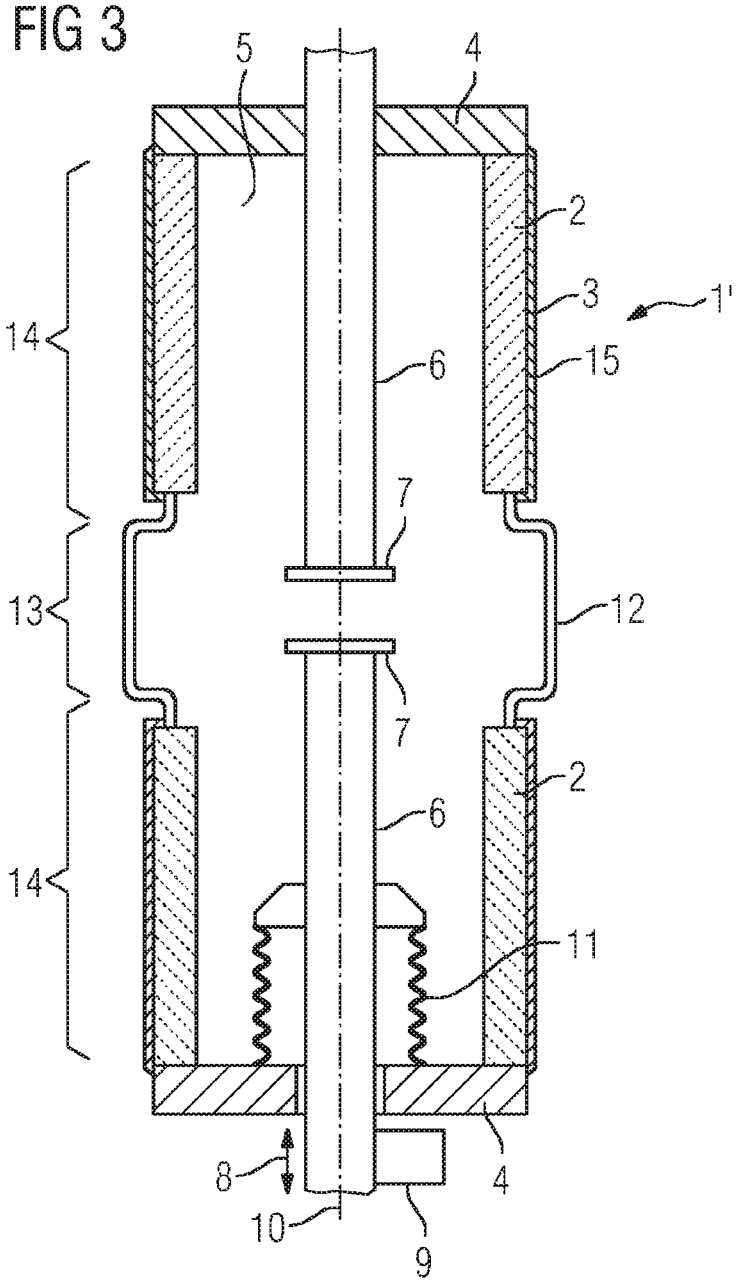
FIG. 3 shows a switching device according to the invention according to a second exemplary embodiment.

FIG. 3 shows a second, slightly modified exemplary embodiment of a switching device 1' according to the invention, again a vacuum interrupter. For the sake of simplicity, functionally identical components are provided with the same reference signs.

As is apparent, the housing 3 again consists of two insulators 2, i.e. tubular ceramic parts, but which are placed at a distance from one another in this case, since the shielding element 12, which has a correspondingly greater radius, is held in the contact-making region 13 therebetween. The coating 15 extends in each case along the outer face of the insulators 2 and is not only conductively connected to the caps 4, but correspondingly also, of course, to the (metal) shielding element 12.

It should also be noted that silicon carbide (SiC) can likewise be used as an alternative to tin oxide, wherein, whenever doping is also intended to be provided there, aluminum (Al) is the preferred doping material.

Although the invention has been illustrated in more detail and described in detail by the preferred exemplary embodiment, the invention is not restricted by the disclosed examples, and other variations can be derived by a person skilled in the art without departing from the scope of protection of the invention.

What is claimed is:

1. An electric switching device, comprising:

at least two conductor elements, a moving mechanism configured to control a distance between the at least two conductor elements and place the at least two conductor elements in contact with one another, a housing that defines a switching chamber, wherein the housing comprises an insulator and at least partially surrounds the at least two conductor elements, wherein at least one side of the housing has a resistive coating comprising a matrix material filled with a filler, wherein the coating has a sheet resistance between $10^8$ and $10^{12}$ ohm at an operating field strength, wherein a concentration or material composition of the resistive coating filler is varied along a longitudinal direction of the electric switching device, the varied concentration or material composition of the resistive coating filler providing a varied sheet resistance of the resistive coating along the longitudinal direction as a function of a change in the electric field along the longitudinal direction under operating conditions, and wherein the coating is conductively connected to the at least two conductor elements.

2. The switching device of claim 1, wherein the coating has a current or voltage characteristic having an upward gradient described by a non-linear exponent of less than 6.

3. The switching device of claim 1, wherein the filler comprises tin oxide $SnO_2$ or silicon carbide SiC.

4. The switching device of claim 3, wherein the filler comprises at least one of tin oxide doped with antimony or silicon carbide doped with aluminum.

5. The switching device of claim 1, wherein the matrix material is selected from the group consisting of elastomers, thermosetting plastics, thermoplastics and glass.

6. The switching device of claim 1, wherein the coating has a thickness of 100 μm to 500 μm.

7. The switching device of claim 1, wherein the filler comprises particles of a grain size of 100 nm to 300 μm.

8. The switching device of claim 7, wherein the particles are platelets made of a base material comprising mica, wherein the platelets are coated with tin oxide $SnO_2$ or silicon carbide SiC, with a layer thickness within the range of 10 to 100 nm, and wherein the particles are outwardly covered by an electrically conductive layer comprising titanium oxide $TiO_2$.

9. The switching device of claim 1, wherein the switching device comprises a vacuum interrupter.

10. The switching device of claim 9 wherein, in a region of contact between the conductor elements, the vacuum interrupter has a shielding element that influences the electric field at the insulator, is arranged within the switching chamber, is held between two housing parts of the housing, and is configured to catch free metal particles of the conductor elements.

11. The switching device of claim 1, wherein the filler concentration is 10% to 90% by weight.

12. The switching device of claim 1, wherein the filler concentration is 40% to 60% by weight.

13. The switching device of claim 1, wherein the filler comprises particles of a grain size of 1 μm to 50 μm.

14. An electric switching device, comprising:

at least two conductor elements, a moving mechanism configured to control a distance between the at least two conductor elements and place the at least two conductor elements in contact with one another, a housing that defines a switching chamber, wherein the housing comprises at least one insulator arranged between a pair of housing end caps and at least partially surrounds the at least two conductor elements, wherein at least one side of the housing has a resistive coating comprising a matrix material filled with a filler, wherein the resistive coating extends over an entire longitudinal length of the electric switching device between the pair of housing end caps, wherein the coating has a sheet resistance between $10^8$ and $10^{12}$ ohm at an operating field strength, and wherein the coating is conductively connected to the at least two conductor elements, wherein a concentration or material composition of the resistive coating filler is varied along a longitudinal direction of the electric switching device, the varied concentration or material composition of the resistive coating filler providing a varied sheet resistance of the resistive coating along the longitudinal direction as a function of a change in the electric field along the longitudinal direction under operating conditions.

15. An electric switching device, comprising:

at least two conductor elements arranged along a central longitudinal axis of the electric switching device, a moving mechanism configured to control a distance between the at least two conductor elements and place the at least two conductor elements in contact with one another, a housing that defines a switching chamber, wherein the housing comprises:

a pair of circumferential insulators at least partially surrounding the at least two conductor elements, and a circumferential shielding element arranged longitudinally between the pair of circumferential insulators in a contact-making region of the electric switching device, wherein a radial distance from the central longitudinal axis of the electric switching device to a radially inward surface of the circumferential shielding element is greater than a radial distance from the central longitudinal axis of the electric switching device to a radially inward surface of each circumferential insulator, wherein at least one side of the housing has a resistive coating comprising a matrix material filled with a filler, wherein the coating has a sheet resistance between $10^8$ and $10^{12}$ ohm at an operating field strength, and wherein the coating is conductively connected to the at least two conductor elements, wherein a concentration or material composition of the resistive coating filler is varied along a longitudinal direction of the electric switching device, the varied concentration or material composition of the resistive coating filler providing a varied sheet resistance of the resistive coating along the longitudinal direction as a function of a change in the electric field along the longitudinal direction under operating conditions.

* * * * *